US007125325B2

(12) United States Patent
Powers, II

(10) Patent No.: US 7,125,325 B2
(45) Date of Patent: Oct. 24, 2006

(54) PORTABLE SHARPENING SYSTEM FOR A DUAL-KNIFE CUTTING MACHINE

(75) Inventor: Woodrow A. Powers, II, Fox Lake, IL (US)

(73) Assignee: Jorson & Carlson Co., Elk Grove Village, IL (US)

( * ) Notice: Subject to any disclaimer, the term of this patent is extended or adjusted under 35 U.S.C. 154(b) by 0 days.

(21) Appl. No.: 10/524,332

(22) PCT Filed: Aug. 19, 2002

(86) PCT No.: PCT/US02/26421

§ 371 (c)(1),
(2), (4) Date: Jun. 20, 2005

(87) PCT Pub. No.: WO2004/016391

PCT Pub. Date: Feb. 26, 2004

(65) Prior Publication Data

US 2005/0239377 A1 Oct. 27, 2005

(51) Int. Cl.
*B24B 7/00* (2006.01)

(52) U.S. Cl. ..... 451/178; 451/193; 451/234; 451/349; 451/419; 451/420; 83/174

(58) Field of Classification Search ..... 451/10, 451/11, 45, 178, 193, 184, 185, 234, 248, 451/349, 419, 420; 83/174, 174.1
See application file for complete search history.

(56) References Cited

U.S. PATENT DOCUMENTS

| | | | | |
|---|---|---|---|---|
| 4,210,045 | A | 7/1980 | Osburg | |
| 4,274,319 | A | 6/1981 | Frye et al. | |
| 4,658,685 | A | 4/1987 | Bodewein | |
| 5,090,281 | A | 2/1992 | Paulson et al. | |
| 5,131,304 | A | 7/1992 | Paavola | |
| 5,503,588 | A * | 4/1996 | Sweet | 451/5 |
| 5,941,148 | A | 8/1999 | Miller et al. | |
| 6,786,808 | B1 * | 9/2004 | Biagiotti | 451/196 |

* cited by examiner

*Primary Examiner*—Eileen P. Morgan
(74) *Attorney, Agent, or Firm*—McDonnell, Boehnen, Hulbert & Berghoff LLP

(57) ABSTRACT

A grinding apparatus (36) for a paper cutting mechanism (10) is shown and includes a coupler (38), for mounting on an upper rail (14) of the cutting mechanism (10), a motor-driven grinder (40), and an adjustable support (42) for adjustably positioning the motor-driven grinder (40) in the direction of the rail (14).

8 Claims, 6 Drawing Sheets

PORTABLE SHARPENING SYSTEM FOR A DUAL-KNIFE CUTTING MACHINE

BACKGROUND OF THE INVENTION

The present invention relates generally to a sharpening apparatus for a dual-knife cutting mechanism of the type used to cut a continuously manufactured paper web and, more particularly, to a portable system for in-line sharpening the lower knife or cutter thereof.

As is well known in the art, paper is conventionally manufactured in a continuous web, several feet in width. The manufacturing equipment represents a huge capital investment, and the dynamics of the process are such that "downtime" is extremely costly.

As a part of this process, a dual-knife mechanism cuts the web longitudinally (i.e., in the direction of web travel) to provide rolls of the desired width or widths. For example, if 8½×11 inch paper is being made, the continuous web is cut into 8½ inch sections, individually rolled for further processing to the desired length of 11 inches.

Such dual-knife mechanisms are shown and described in U.S. Pat. Nos. 4,210,045; 4,274,319; and 4,658,685, and the teachings thereof are expressly incorporated herein by reference. An upper slitter unit, adjustably mounted on a substantially horizontal rail, includes a freely rotating blade, having a tapered peripheral edge. The lower slitter unit, secured to a motor-driven shaft, includes a collar having a tapered side edge. Engagement of blade and collar, or more particularly the blade and tapered side edge of the collar, cuts the paper web in a scissor-like action.

As the slitter units wear, the quality of the cut deteriorates, and maintenance is required. The upper slitter units are often removable from the rail, and sharpening is typically performed as normally scheduled maintenance, e.g., once a week. The associated downtime is usually measured in hours.

Maintenance of the lower slitter units represents a more difficult technical issue. To access the collars, the paper production system, in its entirety, must often be halted and the motor-driven shaft must be disengaged and pulled. Given the enormous weight of this shaft, an overhead crane is often required. The collars are then removed from the shaft and ground. Downtime for this operation can be several days.

SUMMARY OF THE INVENTION

In a principal aspect, the present invention is a grinding apparatus for use with a paper cutting mechanism of the type including upper and lower slitter units. The upper slitter unit is secured on a rail, extending in a first direction.

The grinding apparatus includes a coupler and a motor-driven grinder. The coupler is adapted to receive the rail, such that the grinding apparatus may be mounted upon or within the paper cutting mechanism for in-line operation. The grinder is adapted to engage and sharpen the lower slitter unit.

The grinding apparatus further includes an adjustable support mechanism, securing the motor-driven grinder to the coupler. The adjustable support mechanism allows the grinder to be properly positioned, in the first direction, relative to the lower slitter unit.

It is thus an object of the present invention to provide a portable grinding apparatus for use in high volume paper production and conversion. Another object is a portable knife sharpening apparatus for in-line operation on a dual-knife paper cutting apparatus.

Yet another object is a grinding apparatus, adjustably mountable on the rail carrying the upper slitter units of a dual-knife mechanism, to sharpen the lower slitter units. A further object is an in-line portable grinding apparatus to substantially reduce maintenance downtime.

These and other features, objects and advantages of the present invention are described or implicit in the following detailed description of certain preferred embodiments.

BRIEF DESCRIPTION OF THE DRAWING

Various preferred embodiments of the present invention are described herein with reference to the drawing wherein.

DETAILED DESCRIPTION OF VARIOUS PREFERRED EMBODIMENTS

Figure 1A:
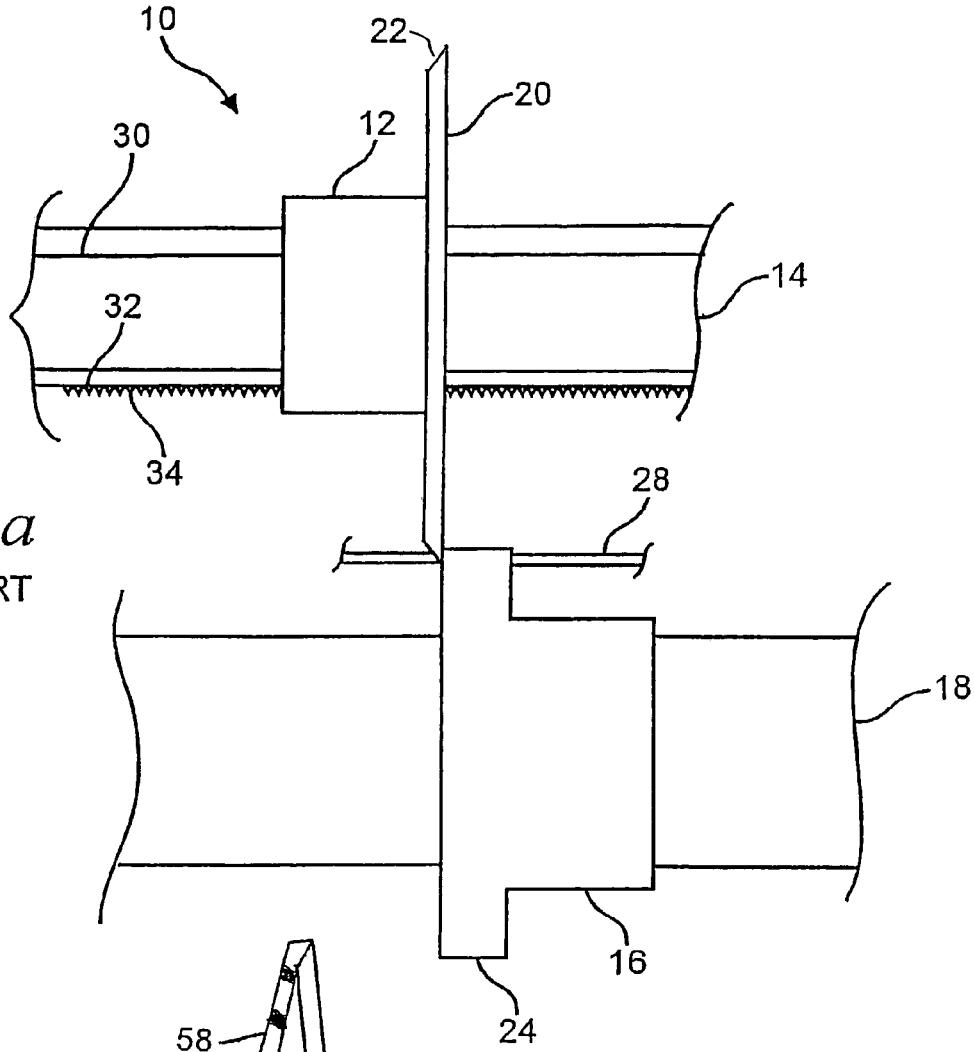
Fig. 1a PRIOR ART
FIG. 1*a* is a partial side view of a prior art dual-knife paper cutting mechanism.
Figure 1B:
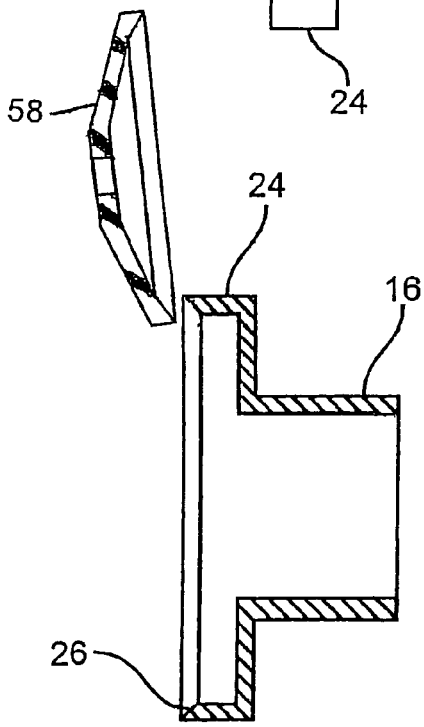
Fig. 1b PRIOR ART
FIG. 1*b* is a cross-sectional view of the lower slitter collar shown in FIG. 1*a* and the grinding wheel shown schematically in FIG. 3, approximately illustrating engagement and orientation for sharpening (grinding angle of three degrees exaggerated for clarity)

With reference first to FIGS. 1*a* and 1*b*, a conventional dual-knife paper cutting system or machine, generally designated 10, is partially shown. The system 10 includes a first, upper slitter unit 12, mounted on an upper slitter rail 14, and a second, lower slitter unit 16, mounted on a lower slitter shaft 18. As is well known in the art, the upper slitter unit 12 is secured (e.g., by a set screw or air-pressurized pins) to the rail 14 and includes a freely rotating blade 20, having a tapered peripheral edge 22. The lower slitter unit 16 is similarly secured to the shaft 18, which is motor-driven. The lower slitter unit 16 includes a collar 24, having a tapered side edge 26. The blade 20 and collar 24 engage to cut a paper web 28 (thickness exaggerated for clarity) in a scissor-like action.

In this cutting system 10, the direction of travel of the web 28 is substantially horizontal at the cutting point. As is well known, the web travel direction may be substantially vertical at that point.

The blade 20 is conventionally biased against the collar 24 (e.g., by a spring or air pressure) during cutting. Given its free rotation, the blade 20 "follows" the motor-driven collar 24. The angle of the tapered peripheral edge 22 is conventionally 30, 45 or 60 degrees; the angle of the tapered side edge 26 is conventionally 2–6 degrees.

The rail 14 extends in a first direction that is generally horizontal and latitudinal across the paper web 28, i.e., substantially perpendicular to the web travel direction. With horizontal web travel at the cutting point, the shaft 18 is substantially vertically aligned with and parallel to the rail 14; with vertical web travel, the shaft 18 is substantially horizontally aligned with and parallel to the rail 14.

Figure 2:
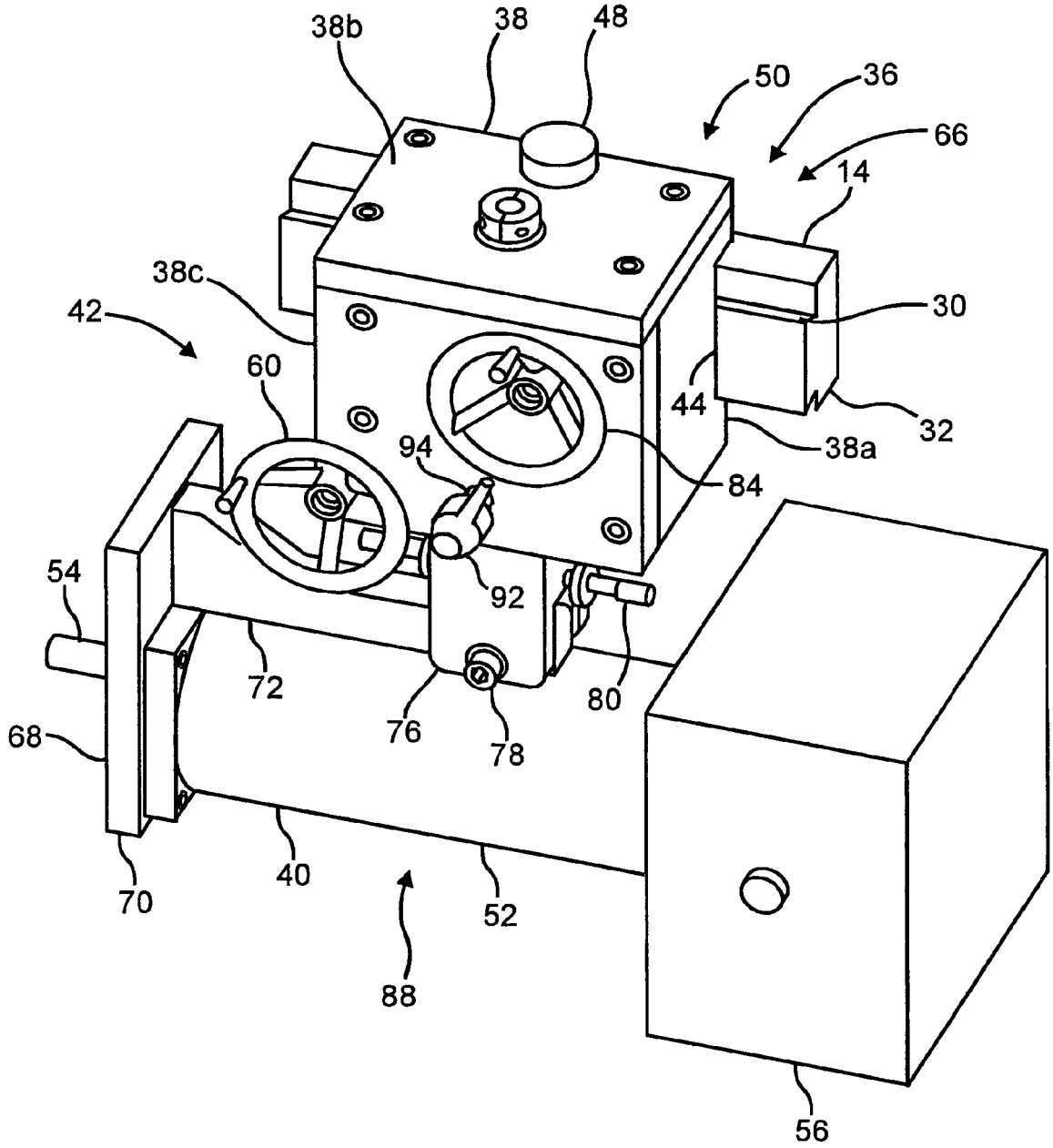
FIG. 2 is a perspective view of a first preferred embodiment of the present invention.
Figure 3:
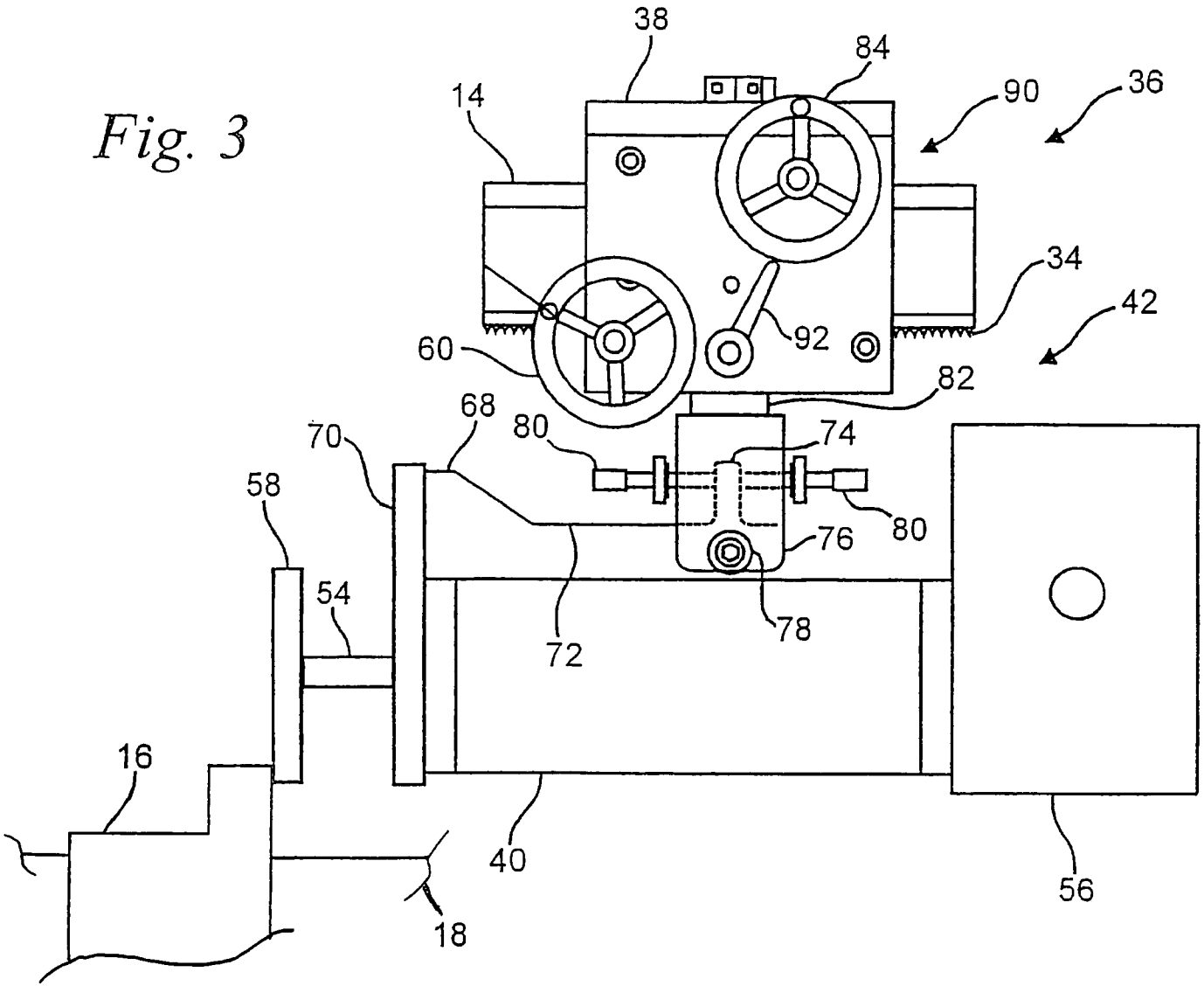
FIG. 3 is a front, partial schematic view of the preferred embodiment of FIG. 2.

As is well known, the configuration of the rail 14 varies from system to system. In this cutting system 10, the rail 14 is substantially T-shaped as best shown in FIG. 2, having first and second generally horizontal surfaces 30, 32, respectively. The second surface 32 is toothed providing a flat gear 34, as shown in FIG. 3. The flat gear 34 facilitates placement and securing of the upper slitter units 12.

As is also well known, the blades 20 and collars 24 wear with use, requiring maintenance. The blades 20 are removed from the rail 14 for sharpening. This particular maintenance requires on the order of 2–8 hours in a typical 15–20 blade cutting system 10.

In order to maintain the collars 24, the shaft 18 often must be disengaged and removed. In a high volume system 10, the shaft 18 may be at least 12 feet long, at least 15 inches in diameter and in excess of 7000 pounds. Given these parameters, maintenance of the collars 24 may result in several days of downtime.

As the blades 20 and collars 24 wear, several problems occur. First, the quality of the cut deteriorates in two regards. The cut drifts and becomes wavy; the cut may also become frayed. Both may render the end product unacceptable. Second, and equally important, poor cutting often produces a significant amount of dust which adversely effects downstream processing or conversion, e.g., printing.

Figure 4:
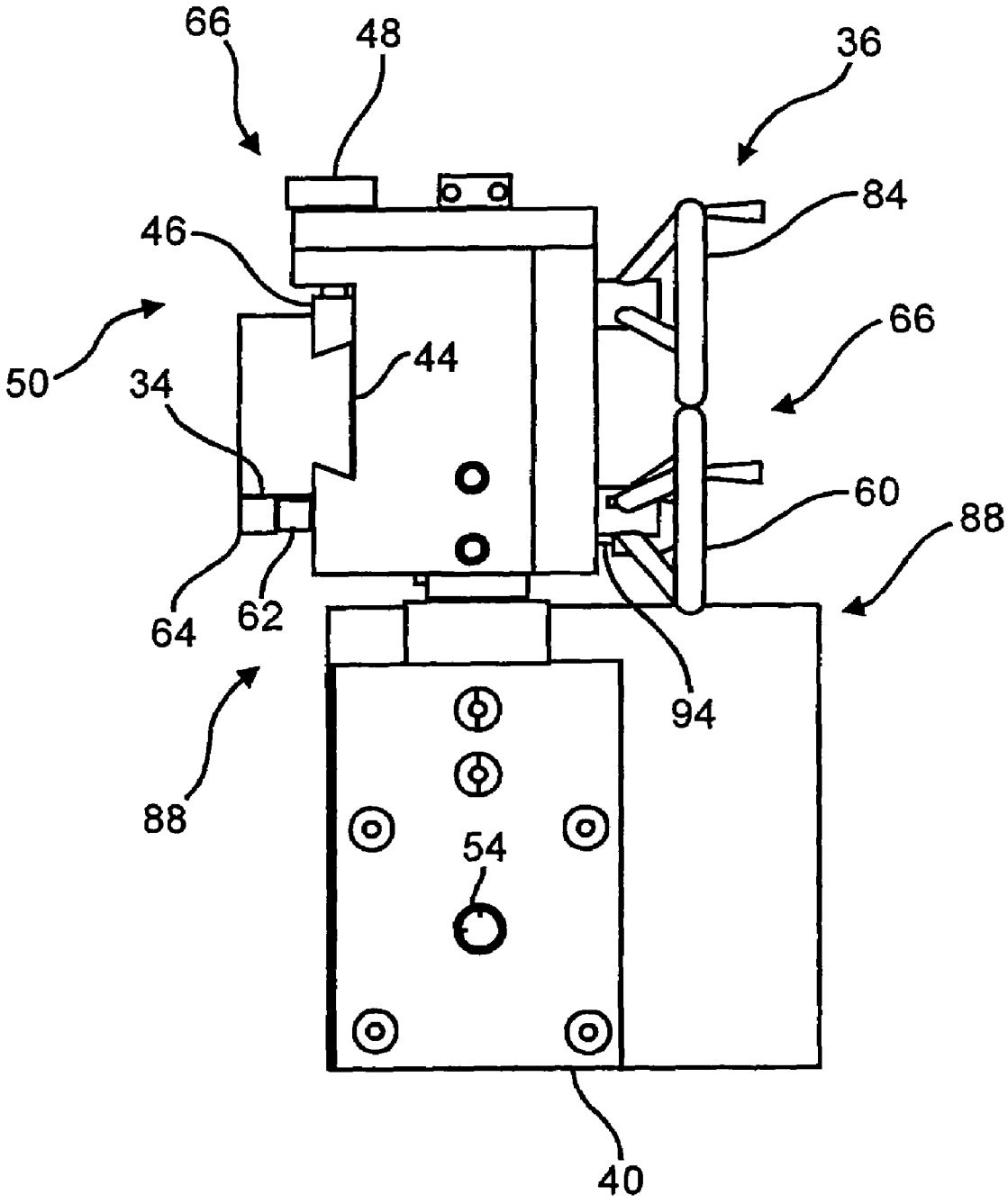
FIG. 4 is a side view of the preferred embodiment of FIG. 2.

Referring now primarily to FIGS. 2–4, a first preferred embodiment of the present invention is shown as a grinding apparatus, generally designated 36, for use with the paper cutting system 10. (For clarity, safety shields are not shown.) The grinding apparatus 36 interconnects within the paper cutting system 10 and, more particularly, is suspended from the rail 14. The grinding apparatus 36 is adapted to sharpen the collar 24 through appropriate grinding of the tapered side edge 26. Significantly, this grinding operation occurs in-line, i.e., within the system 10 and with the collar 24 secured upon the shaft 18.

Figure 5:
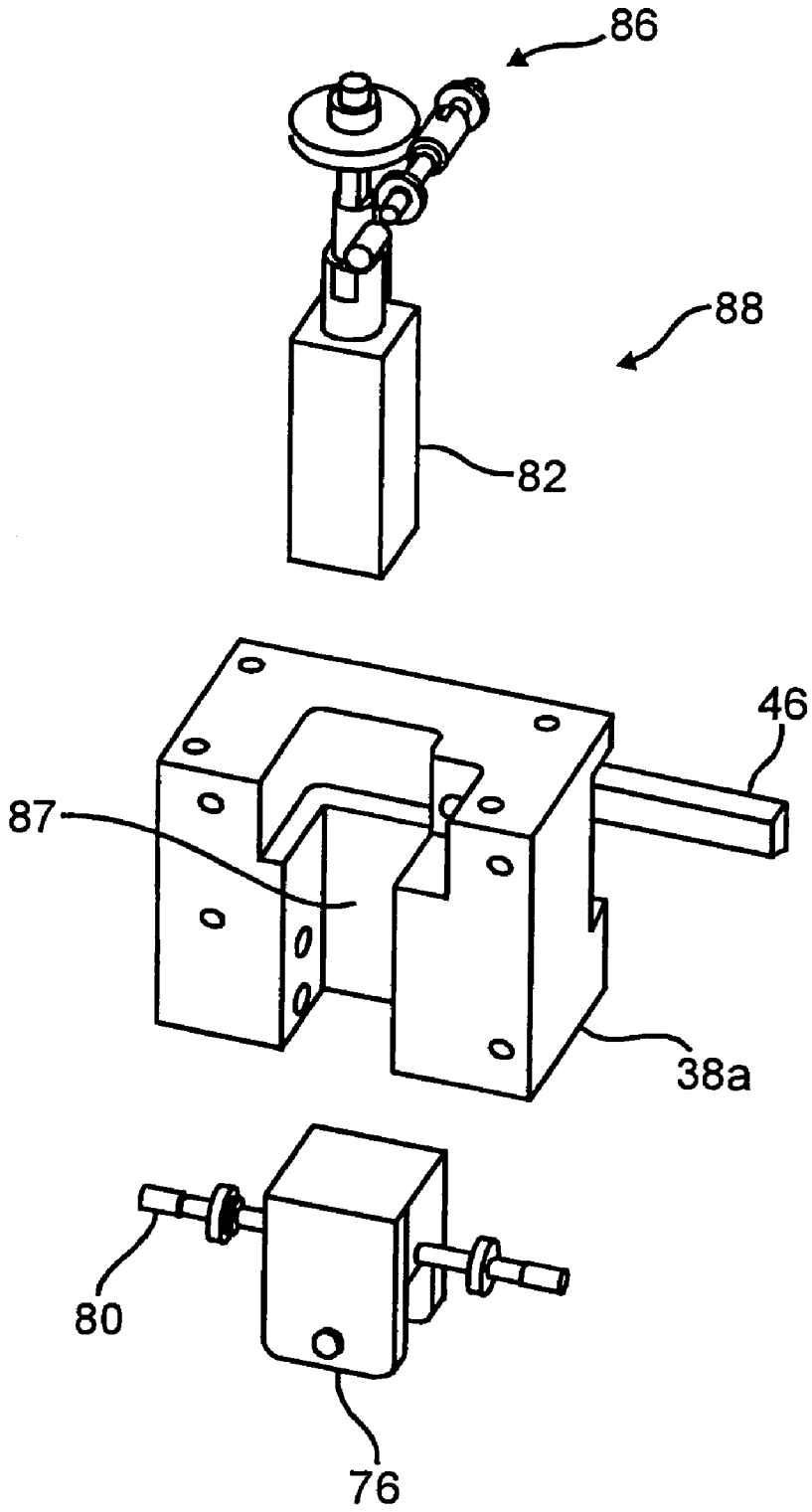
FIG. 5 is a partial exploded view of the adjustable support mechanism shown in FIG. 2.

The grinding apparatus 36 includes a coupler 38, a motor-driven grinder 40, and an adjustable support mechanism or means, generally designated 42. The coupler 38 allows the grinding apparatus 36 to be mounted within the cutting system 10. More particularly, the coupler 38 has a mounting slot 44 adapted to receive the rail 14; the slot 44 generally corresponds to the configuration of the rail 14. As best shown in FIGS. 2,4 and 5, the coupler 38 includes a housing 38*a*, top plate 38*b* and side plate 38*c*.

In this preferred embodiment, the coupler 38 also includes a dovetail gib 46, within the slot 44 and operably connected to a gib knob 48. With the gib 46 fully retracted, the coupler 38 may be initially mounted at any point along the rail 14. Rotation of the knob 48 to an intermediate position tightens the gib 46 against the first surface 30 of the rail 14 to secure the mounting. Further rotation thereof locks the coupler 38 with respect to the rail 14, such that the gib 46 and knob 48 cooperate to define brake means, generally designated 50. Loosening of the knob 48 from the intermediate position allows the coupler 26 to be manually moved along to rail 14, such that the grinder 40 may be readily positioned in close proximity to the collar 24 to be sharpened.

Referring again to FIGS. 2 and 3, the motor-driven grinder 40 includes a variable speed motor 52, having a motor shaft 54, a manual speed control 56 operatively coupled to the motor 52, and a grinding wheel 58, mounted on the shaft 54. The motor 52 and speed control 56 are conventional and powered by a standard 120 volt AC supply (not shown). The motor 52 provides grinding speeds of up to 3600 rpm; speed control facilitates grinding accuracy.

The adjustable support means 42 attaches the coupler 38 and motor-driven grinder 40. The adjustable support means secures the grinder 40 to the coupler 38 such that the motor shaft 54 is generally aligned with the rail 14 and shaft 18.

Further the adjustable support means 42 adjustably positions the motor-driven grinder 40 with respect to the lower slitter unit 16 or, more particularly, the grinding wheel 58 with respect to the collar 24. The adjustable support means 42 provides linear movement of the motor-driven grinder 40 in the first direction as defined by the rail 14.

In this preferred embodiment, the adjustable support means 42 additionally provides linear movement of the grinder 40 with respect to the lower slitter unit 16 in a second direction, substantially perpendicular to the first direction. With respect to the cutting system 10 shown herein, the second direction is substantially vertical. For purposes hereof, the first and second directions correspond to the X and Y axes, respectively, of a three-dimensional rectangular coordinate system.

The adjustable support means 42 also provides, in this preferred embodiment, adjustable orientation of the grinder 40 and grinding wheel 58 with respect to the lower slitter unit 16 and collar 24. The adjustable support means 42 permits the grinder 40 to be rotated about the Z axis, i.e., an axis substantially perpendicular to the first and second directions.

Regarding adjustment in the first or X direction, the adjustable support means 42 includes a first hand-actuated crank 60, having a first shaft 62 and first gear 64. The first shaft 62 extends through the coupler housing 38*a* and side plate 38*c* substantially perpendicular to the rail 14, and the first gear 64 engages the flat gear 34 on the rail 14. Rotation of the crank 60 drives the coupler 38 along the rail 14. As such, the crank 60, first shaft 62 and first gear 64 cooperate to define first positioning means, generally designated 66, for selectively moving the coupler 38 along the rail 14, whereby the grinder 40 is adjustably positioned in the first direction.

Referring now to FIGS. 2–4, the adjustable support means 42 includes a first, substantially L-shaped bracket 68, secured to the motor 52. The motor shaft 54 passes through a substantially vertical leg 70 of the bracket 68. A substantially horizontal leg 72 thereof extends longitudinally along the motor 58, towards the speed control 56 and away from the grinding wheel 58. Opposite the vertical leg 70, the bracket 68 includes an orienting arm 74 (shown in phantom in FIG. 3), extending from the horizontal leg 72 away from the grinder 40.

The leg 72 is connected to a substantially U-shaped mount 76 through a conventional pin connector 78, allowing rotation of the grinder 40 or, more particularly, the wheel 58 about the Z axis, i.e., the longitudinal axis of the pin connector 78. The mount 76 includes a two-sided screw lock 80 to engage the orienting arm 74 and hold the desired orientation.

Referring now primarily to FIGS. 3 and 5, the U-shaped mount 76 is, in turn, secured to a substantially rectangular slide 82. The slide 82 is operatively coupled to a second hand-actuated crank 84 through a conventional right-angle worm gear assembly, generally designated 86. The slide 82 partially resides within a chamber 87, defined by the housing 38*a* and side plate 38*c*.

Rotation of the crank 84 moves, or positionally adjusts, the grinder 40 relative to the lower slitter unit 16. The slide 82, crank 84 and worm gear 86 cooperate to define second positioning means, generally designated 88, for selectively positioning the grinder 40 with respect to the coupler 38 in the second or Y direction.

Referring now primarily to FIGS. 2 and 5, the grinding apparatus 36 includes a second brake, generally designated 90, for locking the second positioning means 88. The brake 90 includes a hand-actuated handle 92 connected to a threaded shaft 94. The shaft 94 extends through the side plate 38*c*. Rotation of the handle 92 drives the shaft 94 against the slide 82, frictionally retaining its position.

In terms of operation, the grinding apparatus 36 is initially mounted at one end of the rail 14, adjacent a first collar 24. The brake means 50 is locked. The brake 90 is released and the grinder 40 is appropriately positioned utilizing the second positioning means 88. The grinder 40 is then oriented and locked utilizing the two-sided screw lock 80. The motor 52 is engaged and the appropriate speed is selected. The brake means 50 is then released and the grinding wheel 58 is urged against the collar 24 through the first positioning means 66, until the desired angle on the tapered side edge 26 is achieved. Next the grinder 40 is retracted in the first direction and elevated in the second direction, such that the grinding apparatus 36 may be advanced to the next collar 24, without removal thereof from the rail 14.

In-line sharpening of the collars 24 enhances accuracy of the resultant angle. Minor misalignment of the collar 24 respect to the shaft 18 is substantially overcome.

The first preferred embodiment of the present invention takes advantage of the flat gear 34 found on the rail 14. As those skilled in the art will appreciate, where the rail 14 lacks such a gear, one may be added as a part of the present invention.

Those skilled in the art will also recognize that adjustment in the X and Y directions and orientation in the Z direction may be achieved in different ways. For example, adjustment in the X direction need not require movement of the coupler 38 along the rail 14. Rather, adjustable positioning of the motor-driven grinder relative to the lower slitter unit, in the first direction, may be achieved by movement of the U-shaped mount 76 relative to the slide 82.

Figure 6:
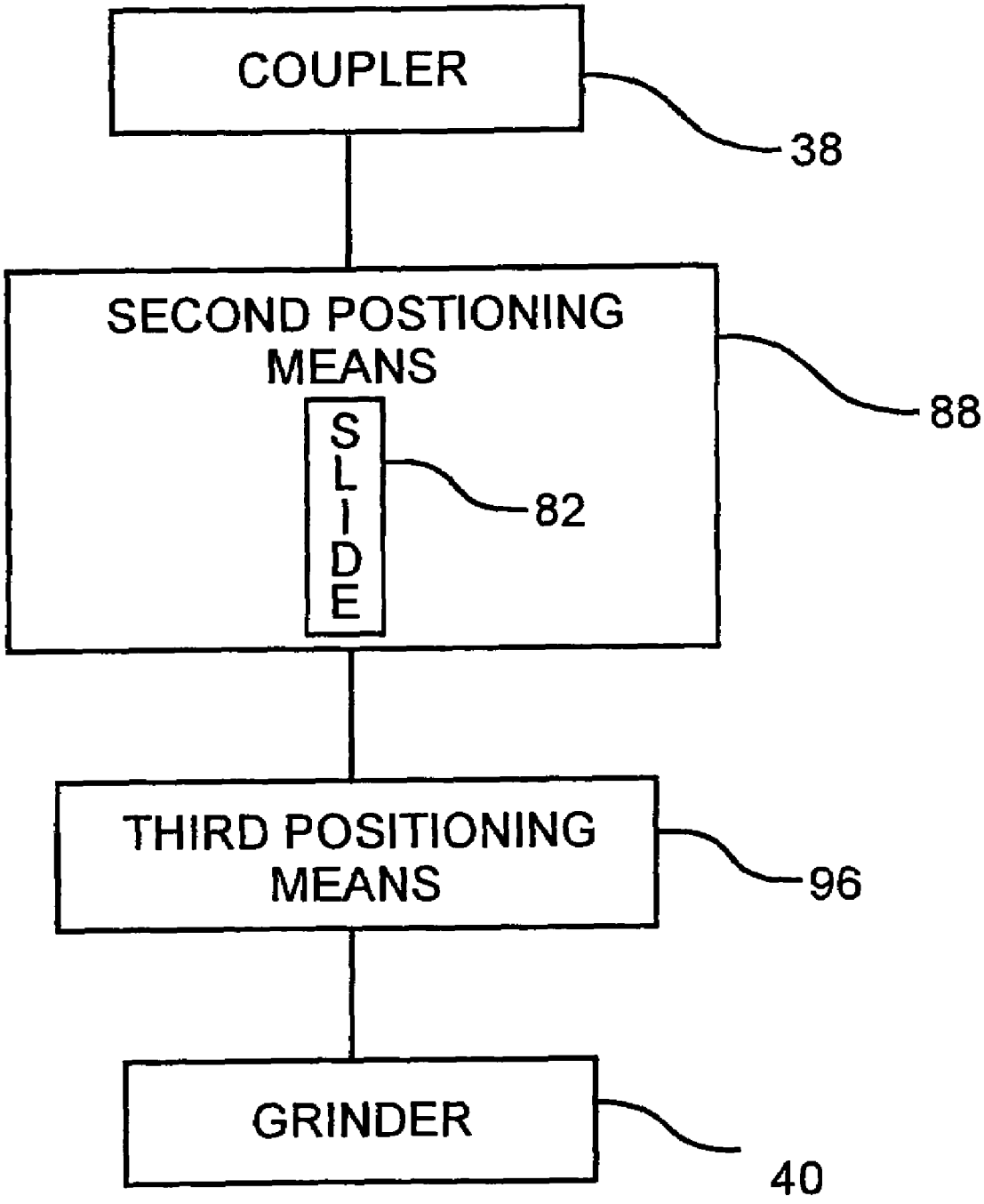
FIG. 6 is a partial schematic view of a second preferred embodiment of the present invention.

This second embodiment of the present invention is schematically shown in FIG. 6. Here a third positioning means 96 (replacing the first positioning means 66) selectively moves the grinder 40 with respect to the coupler 38.

Finally, it will be recognized that the linear movement in the first and second preferred embodiments, through gear assemblies (i.e., flat gear 34/first gear 62 and worm gear 86), may be achieved by other mechanisms. For example, stepper motors and/or pistons may be substituted.

Preferred embodiments of the present invention have been described in detail. It is to be understood, however, that changes and modifications can be made without departing from the true scope and spirit of the invention as defined by the following claims, which are to be construed and interpreted in view of the foregoing.

What is claimed is:

1. A grinding apparatus for use with a paper cutting mechanism, said paper cutting mechanism including an upper slitter unit on a rail and an associated lower slitter unit, said rail extending in a first direction, said grinding apparatus comprising, in combination:

a coupler receiving said rail and mounting said grinding apparatus thereon;

a motor-driven grinder to engage and sharpen said lower slitter unit;

adjustable support means, interposing said coupler and said motor-driven grinder, for securing said motor-driven grinder to said coupler and for adjustably positioning said motor-driven grinder relative to said lower slitter unit in said first direction.

2. A grinding apparatus as claimed in claim 1 wherein said adjustable support means adjustably positions said motor-driven grinder relative to said lower slitter unit in a second direction substantially perpendicular to said first direction.

3. A grinding apparatus as claimed in claim 2 wherein said adjustable support means adjustably orients said motor-driven grinder relative to said lower slitter unit about an axis substantially perpendicular to said first direction and said second direction.

4. A grinding apparatus as claimed in claim 1 wherein said adjustable support means includes positioning means for selectively moving said coupler with respect to said rail, whereby said the motor-driven grinder is adjusted in said first direction.

5. A grinding apparatus as claimed in claim 4 wherein said positioning means includes a first gear engaging said rail.

6. A grinding apparatus as claimed in claim 4 wherein said adjustable support means adjustably positions said motor-driven grinder relative to said lower slitter unit in a second direction substantially perpendicular to said first direction.

7. A grinding apparatus as claimed in claim 6 wherein said adjustable support means includes a second positioning means for selectively moving said motor-driven grinder with respect to said coupler, whereby said motor-driven grinder is adjusted in said second direction.

8. A grinding apparatus as claimed in claim 7 wherein said adjustable support means adjustably orients said motor-driven grinding wheel relative to said lower slitter unit about an axis substantially perpendicular to said first direction and said second direction.

* * * * *